US008780152B2

(12) United States Patent
Heath

(10) Patent No.: US 8,780,152 B2
(45) Date of Patent: Jul. 15, 2014

(54) METHOD AND APPARATUS FOR THERMAL EXPANSION BASED PRINT HEAD ALIGNMENT

(71) Applicant: Electronics for Imaging, Inc., Foster City, CA (US)

(72) Inventor: Peter Heath, Alexandria, NH (US)

(73) Assignee: Electronics for Imaging, Inc., Fremont, CA (US)

( * ) Notice: Subject to any disclaimer, the term of this patent is extended or adjusted under 35 U.S.C. 154(b) by 0 days.

(21) Appl. No.: 13/913,279

(22) Filed: Jun. 7, 2013

(65) Prior Publication Data

US 2013/0271549 A1 Oct. 17, 2013

Related U.S. Application Data

(63) Continuation of application No. 13/301,624, filed on Nov. 21, 2011, now Pat. No. 8,477,165.

(51) Int. Cl.
*B41J 2/32* (2006.01)

(52) U.S. Cl.
USPC ..... 347/198

(58) Field of Classification Search
USPC ..... 347/171, 197, 198, 211, 222
See application file for complete search history.

(56) References Cited

U.S. PATENT DOCUMENTS

| | | | | |
|---|---|---|---|---|
| 5,450,099 | A * | 9/1995 | Stephenson et al. | 347/211 |
| 6,793,323 | B2 | 9/2004 | Silverbrook | |
| 7,090,335 | B2 | 8/2006 | Silverbrook | |
| 7,561,362 | B2 | 7/2009 | Nagai et al. | |
| 7,810,906 | B2 | 10/2010 | Silverbrook | |
| 8,477,165 | B2 * | 7/2013 | Heath | 347/198 |
| 2002/0180846 | A1 | 12/2002 | Silverbrook et al. | |
| 2004/0141041 | A1 | 7/2004 | Tsutsumi et al. | |
| 2005/0151817 | A1 | 7/2005 | Godil et al. | |
| 2006/0012664 | A1 * | 1/2006 | Jeong | 347/211 |
| 2006/0023057 | A1 * | 2/2006 | Jung | 347/171 |
| 2006/0109304 | A1 | 5/2006 | Williams et al. | |
| 2006/0158505 | A1 * | 7/2006 | Jin | 347/171 |
| 2006/0232623 | A1 | 10/2006 | Murcia et al. | |
| 2010/0309254 | A1 | 12/2010 | Silverbrook et al. | |
| 2011/0025755 | A1 | 2/2011 | Rosati et al. | |
| 2011/0242187 | A1 | 10/2011 | Mongeon et al. | |
| 2011/0279513 | A1 | 11/2011 | Mizes et al. | |

FOREIGN PATENT DOCUMENTS

| | | |
|---|---|---|
| WO | WO-0239160 | 5/2002 |

* cited by examiner

*Primary Examiner* — Kristal Feggins
(74) *Attorney, Agent, or Firm* — Michael A. Glenn; Perkins Coie LLP

(57) ABSTRACT

Automated print head alignment uses thermal expansion. By leveraging thermal expansion to position print heads within the carriage, the tedious manual adjustment process is eliminated. The need for costly precision references within the printer and on the print head is also reduced.

29 Claims, 5 Drawing Sheets

METHOD AND APPARATUS FOR THERMAL EXPANSION BASED PRINT HEAD ALIGNMENT

CROSS REFERENCE TO RELATED APPLICATIONS

This application is a continuation of U.S. patent application Ser. No. 13/301,624, filed Nov. 21, 2011, which application is incorporated herein in its entirety by this reference thereto.

BACKGROUND OF THE INVENTION

1. Technical Field

The invention relates to printing. More particularly, the invention relates to a method and apparatus for thermal expansion based print head alignment.

2. Description of the Background Art

Aligning large numbers of print heads is time consuming and/or costly. Print heads are currently aligned within the printer using precision mechanical references, manually adjusted by mounts, or adjusted by motors. Initially, the carriage plates the support the print heads must be machined very accurately to place the print heads exactly where they should be. Doing so is expensive and not always as accurate as required. Further, variability in manufacturing the print heads themselves means the print heads are not always positioned where they need to be. The state of the art provides an adjustment screw. The operator manually turns the screw to push the print heads forward or back. This procedure is very time consuming. After making such adjustment, the operator prints a pattern, inspects it, and measures it with a microscope. Then the operator makes another adjustment. This procedure is repeated, and typically four hours or more have elapsed before the alignment is done.

Some alignment techniques attempt to use thermal expansion to compensate for print head movement during operation. That is, the print heads are intentionally misaligned during manufacture to allow them to move into alignment when they are at an operating temperature in the field. For example, see U.S. Pat. No. 6,793,323, Thermal Expansion Compensation for Modular Printhead Assembly; U.S. Pat. No. 7,090,335, Thermal Expansion Compensation for Printhead Assembly; and U.S. Pat. No. 7,810,906, Printhead Assembly Incorporating Heat Aligning Printhead Modules. Such approach leaves much to serendipity because operating conditions vary widely in the field and no mechanism is provided for realigning the print heads if they are out of alignment in the field when at an operating temperature.

It would be advantageous to provide a mechanism that addresses the problem of aligning print heads in the field, and that allows such alignment to be performed as needed without the need for time consuming and/or costly procedures.

SUMMARY OF THE INVENTION

An embodiment of the invention provides automated print head alignment using thermal expansion. By leveraging thermal expansion to position print heads within the carriage, the tedious manual adjustment process is eliminated. The invention also reduces the need for costly precision references within the printer and on the print head. At least in bulk, as in a highly populated printer, the herein disclosed thermal expansion adjustment technique is more cost-effective than either rotary or piezo motors.

BRIEF DESCRIPTION OF THE DRAWINGS

FIG. 3A is an alignment image for print heads that are offset from other print heads, and where FIG. 3B is an alignment image for print heads that are inline with other print heads;

DETAILED DESCRIPTION OF THE INVENTION

An embodiment of the invention provides automated print head alignment using thermal expansion. By leveraging thermal expansion to position print heads within the carriage, the tedious manual adjustment process is eliminated. The invention also reduces the need for costly precision references within the printer and on the print head. At least in bulk, as in a highly populated printer, the herein disclosed thermal expansion adjustment technique is more cost-effective than either rotary or piezo motors.

Figure 1:
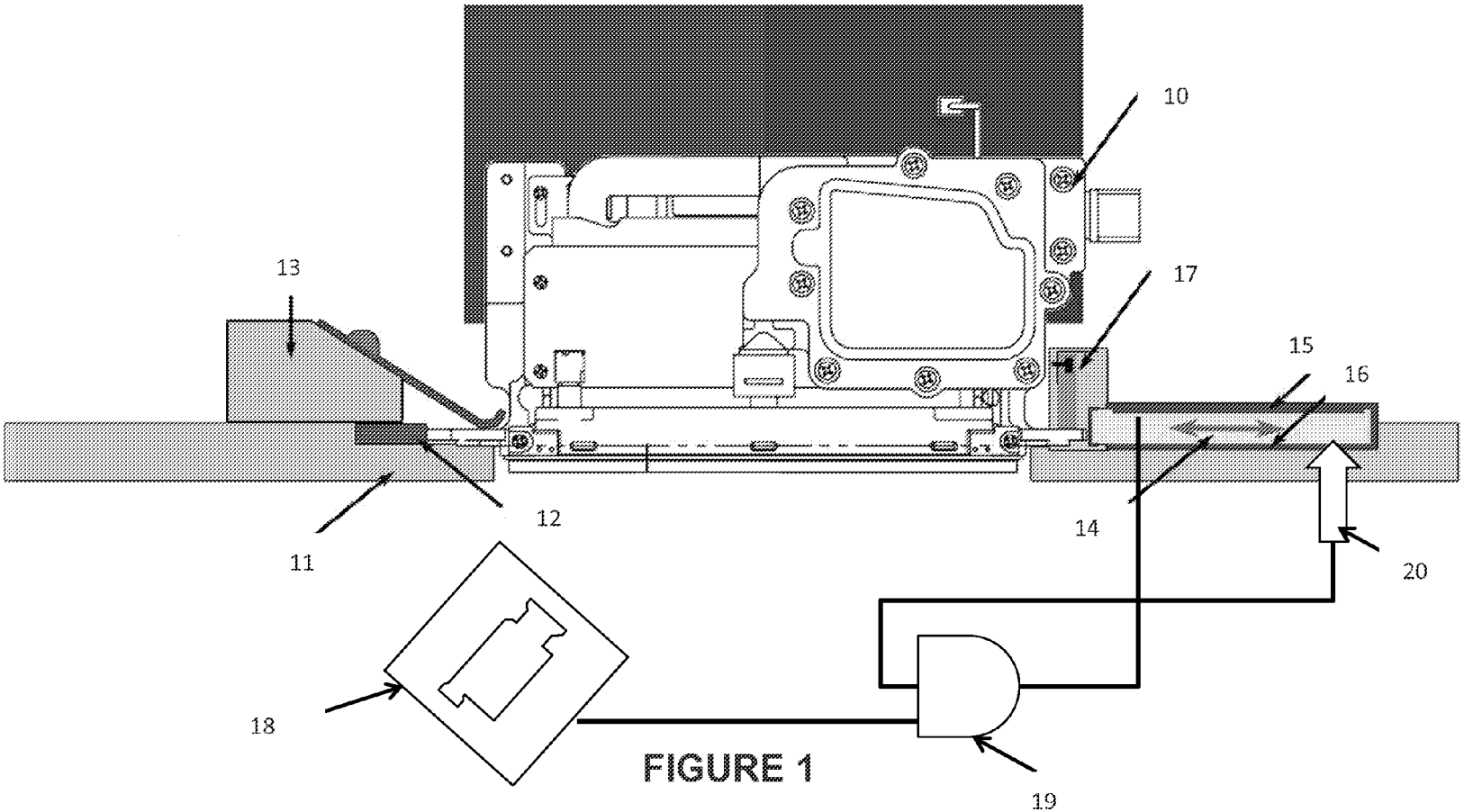
FIG. 1 is a side view of a printer that incorporates a mechanism for thermal expansion based print head alignment according to the invention.

FIG. 1 is a side view of a printer that incorporates a mechanism for thermal expansion based print head alignment according to the invention. As shown in FIG. 1, an embodiment of the invention comprises a print head 10 mounted into a carriage plate 11. The print head is spring loaded in one direction by a horizontal spring 12, and the plate is equipped with a damping mechanism 13 that is capable of holding the print head in place. Opposite the spring is an expansion block 14 that is held farthest from the print head by the carriage plate. The expansion block is equipped with a heater element 15 that provides the expansion heat. The expansion block is held away from the carriage plate by a thermal insulator material 16.

The expansion block can be made of a high thermal coefficient of expansion material, such as a Zinc alloy or other material. In the presently preferred embodiment of the invention, the expansion block is made of commercial zinc that preferably has a thermal coefficient of linear expansion of 0.000019"/"/° F. Those skilled in the art will appreciate that the expansion block may be made of other materials and may have other thermal coefficients of linear expansion. Examples of such materials include, but are not limited to acetal, with a thermal coefficient of linear expansion of 0.000059"/"/° F., acrylonitrile butadiene styrene (ABS), with a thermal coefficient of linear expansion of 0.000041, and polyetheretherketone (PEEK), with a thermal coefficient of linear expansion of 0.000025.

The heater element can comprise, for example, a silicon rubber heater, such as McMaster Carr's 35765K364 1"×2" heater (a similar heater is available from Hi-Heat); or it can comprise a kapton heater, such as Omega's KH-103/10-P (a similar heater is available from Minco/Honeywell). Those skilled in the art will appreciate that other heaters may be used in various embodiments of the invention.

Figure 2:
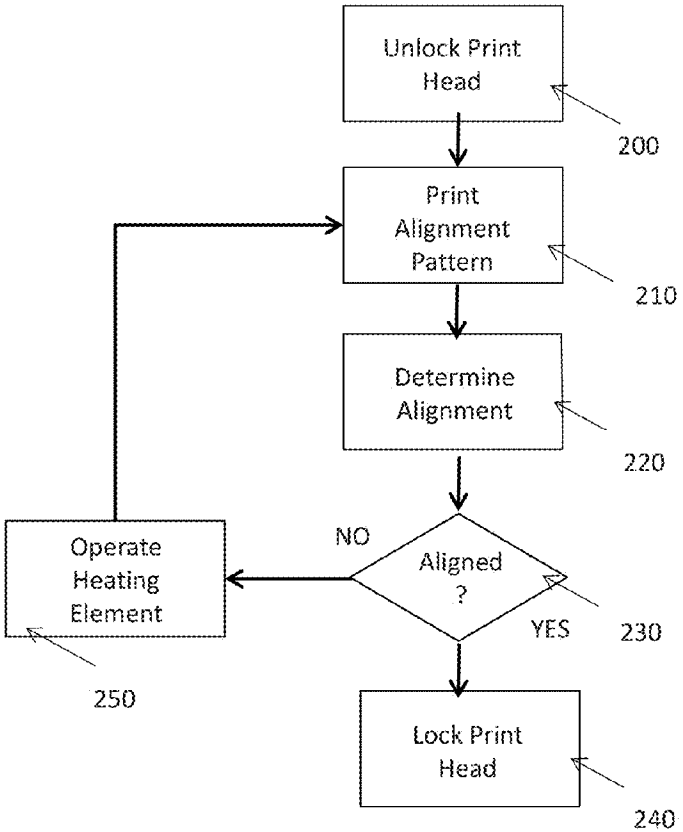
FIG. 2 is a flow diagram showing operation of the mechanism for thermal expansion based print head alignment according to the invention.

FIG. 2 is a flow diagram showing operation of the mechanism for thermal expansion based print head alignment according to the invention. At the beginning of the automated alignment process, the operator releases a cam driven lock down 17 on the heads to be aligned (200). The printer then prints an alignment pattern (see FIGS. 2A and 2B, discussed below) with the heads in question (210) and analyses the resulting pattern (220) with its imaging system 18. In some embodiments of the invention, these patterns are stored in the printer itself and the alignment procedure is instituted by operator control, for example by selecting an alignment routine from a touch panel on the printer itself, or via a network command to the printer. The imaging system may be a camera or other imaging device associated with the printer, or it may be a retrofittable device.

If the heads need to be moved (230), a control system 19 increases the heater temperature using a pulse width modulated (PWM) drive signal (250). The control system then slightly delays further application of the drive signal to the heater, thus allowing the heater temperature to settle. For faster response, a thermocouple feedback mechanism 20 can be installed. The control system adjusts the PWM and repeats the printed test as required until the head is in position. In some circumstances, if the amount of adjustment is too great (overshoot), then expansion block is allowed to cool, such that the horizontal spring moves the print heads back into alignment. Thus, adjustment is effected both to the left and to the right as necessary.

Once proper alignment is achieved, the operator is signaled to activate the lock down to hold the head in position (240). The heater is then deactivated and the expansion block contracts, but the print heads remain locked in alignment. Alternatively, the control system can operate a solenoid or other electro-mechanical actuator (not shown) to engage the lock down automatically when proper alignment is achieved.

Figure 3A:
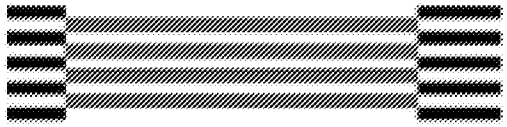
FIGS. 3A and 3B are schematic representations of alignment images for use in connection with the herein disclosed invention, where
Figure 3B:
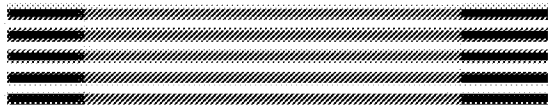

The important part of the alignment images can be seen on FIGS. 3A and 3B, these are the parts that the imaging system evaluates. The rest of the image is provided to make it human-readable for manual adjustment. Some print heads are offset from the other print heads. For these heads the correct pattern is as shown in FIG. 3A. The middle section (lighter shade on FIG. 3A) is one print head, the outside section (darker shade on FIG. 3A) is another print head. The thermal expansion block on the given head (middle section) is adjusted until the lines for the section are in the middle of the lines for the other section. Some print heads are inline with other print heads. For these print heads the correct pattern is as shown in FIG. 3B. The middle section (lighter shade on FIG. 3B) is one print head, the outside section (darker shade on FIG. 3B) is another print head. The thermal expansion block on the given head (middle section) is adjusted until the lines are inline with those the other section.

Figure 4:
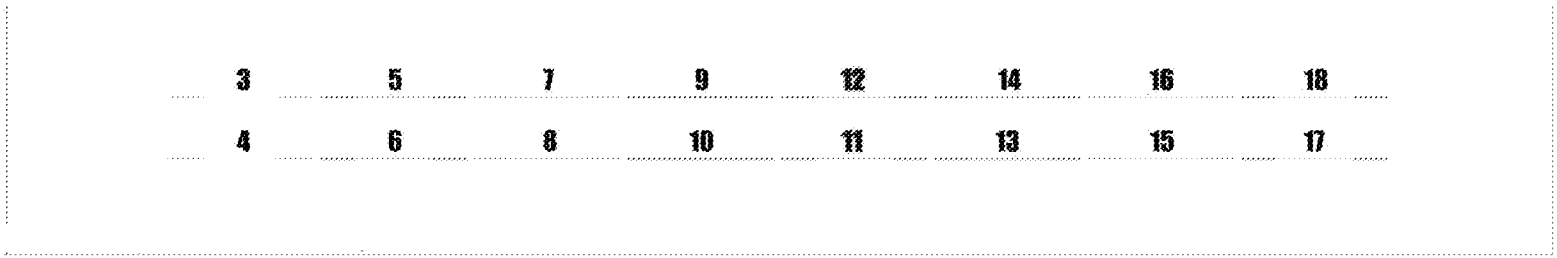
FIG. 4 is a representation of an array of alignment images for print heads in a color printer having 600×360 dpi resolution according to the invention.

FIG. 4 is a representation of an array of alignment images for print heads in a color printer having 600×360 dpi resolution. In aligning the print heads for such a printer using the herein disclosed invention, test prints and imaging steps are performed as described above. In this embodiment, heads 11 and 12 align the offset to the middle of the darker lines, while the other heads are aligned inline. Heads 11 and 12 are preferably aligned first using the technique described above. Heads 9 and 10 are typically aligned prior to using the test pattern, for example as part of a factory adjustment.

In an embodiment, there is one heater and expansion block for every print head. This allows the operator to align all of the print heads to each other. Thus, an alignment is performed first for one print head, and then it is performed for a next print head until all of the print heads are aligned. Alternatively, the print heads may all be aligned at the same time. In this case, there is a reference print head, which in FIG. 4 is print head 9. In this embodiment, the herein disclosed mechanism is used to align all of the other print heads to the reference print head.

Computer Implementation

Figure 5:
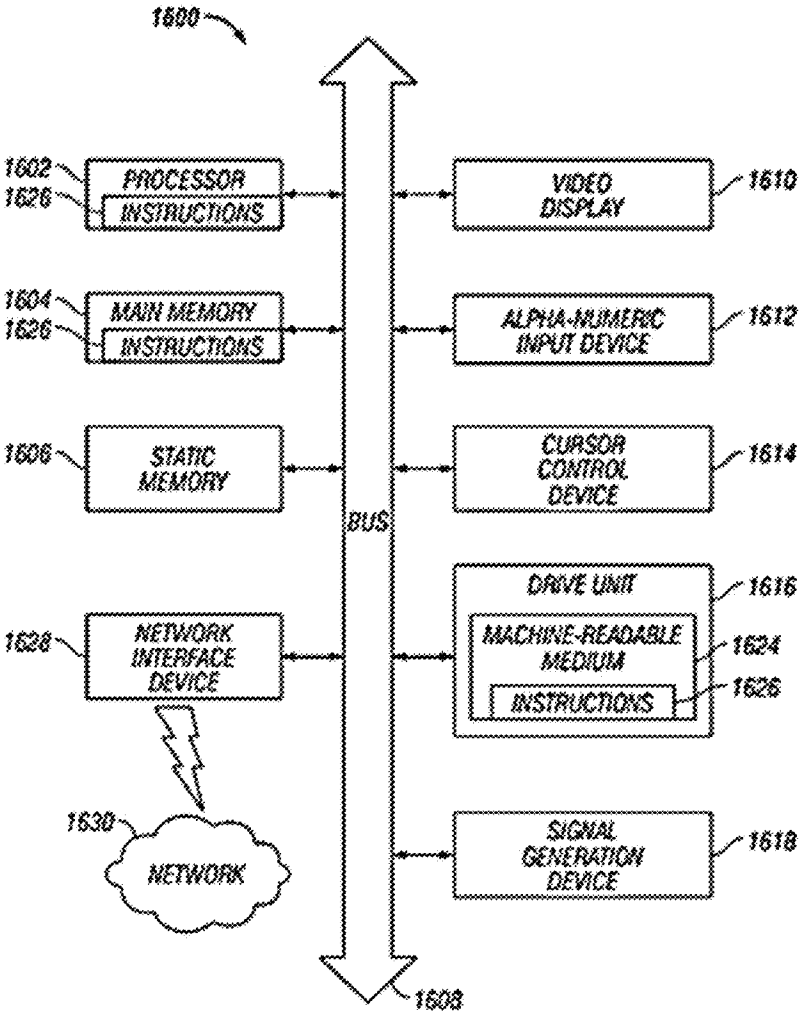
FIG. 5 is a block schematic diagram of a machine in the exemplary form of a computer system within which a set of instructions may be executed to cause the machine to perform any of the herein disclosed methodologies.

FIG. 5 is a block schematic diagram of a machine in the exemplary form of a computer system 1600 within which a set of instructions for causing the machine to perform any one of the foregoing methodologies may be executed. In alternative embodiments, the machine may comprise or include a network router, a network switch, a network bridge, personal digital assistant (PDA), a cellular telephone, a Web appliance or any machine capable of executing or transmitting a sequence of instructions that specify actions to be taken.

The computer system 1600 includes a processor 1602, a main memory 1604 and a static memory 1606, which communicate with each other via a bus 1608. The computer system 1600 may further include a display unit 1610, for example, a liquid crystal display (LCD) or a cathode ray tube (CRT). The computer system 1600 also includes an alphanumeric input device 1612, for example, a keyboard; a cursor control device 1614, for example, a mouse; a disk drive unit 1616, a signal generation device 1618, for example, a speaker, and a network interface device 1628.

The disk drive unit 1616 includes a machine-readable medium 1624 on which is stored a set of executable instructions, i.e., software, 1626 embodying any one, or all, of the methodologies described herein below. The software 1626 is also shown to reside, completely or at least partially, within the main memory 1604 and/or within the processor 1602. The software 1626 may further be transmitted or received over a network 1630 by means of a network interface device 1628, In contrast to the system 1600 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with complementary metal oxide semiconductor (CMOS), transistor-transistor logic (TTL), very large systems integration (VLSI), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g., a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention is described herein with reference to the preferred embodiment, one skilled in the art will readily appreciate that other applications may be substituted for those set forth herein without departing from the spirit and scope of the present invention.

For example, the use of thermal expansion as described herein may be applied to adjust the print heads in more than one direction per print head. Thus, the invention may be used to make adjustments either, or both of, the X and Y dimensions, i.e. left and right and forward and backward.

Further, embodiments of the invention may include a reporting or recording mechanism that tracks the history of the alignment adjustments. The history is useful in identifying changes in alignment over time, for example to determine how the jets or print heads impact the prints, to identify wear and the need for maintenance, to determine how much and how often the heads should be aligned (and thus establish a maintenance schedule, and/or to identify patterns in certain batches of print heads or other components. In an embodiment, this feature of the invention is implemented with an inspection camera, and the results are stored in the printer memory.

Finally, an embodiment of the invention instruments the herein disclosed mechanism to provide remote diagnostics. For example, the expansion blocks are not only used to adjust the location of the heads, but the system may include sensors associated with the expansion mechanism and/or print heads to ascertain the location of the heads remotely. For example, in an embodiment expansion to a determined resistance threshold, as measured by a strain sensor in line with, or influenced by, the expansion blocks, provides data to allow remote viewing of print head alignment.

Accordingly, the invention should only be limited by the Claims included below.

The invention claimed is:

1. An apparatus for automated print head alignment, comprising:

a processor based control system in communication with a heater element and an imaging system, said control system causing an alignment pattern to be printed, receiving and analyzing imaging information from said imaging system, and controlling operation of said heater element in accordance therewith to heat an expansion block, wherein resulting linear expansion of said expansion block moves at least one print head to effect print head alignment, said control system further effecting repeated printing of said alignment pattern, receipt and analysis of said imaging information, and operation of said heater element until a printed alignment pattern indicates that correct print head alignment has been achieved.

2. The apparatus of claim 1, further comprising:

a carriage plate configured for receiving at least two print heads; and a biasing mechanism for urging at least one of said at least two print heads in a first direction along an alignment path.

3. The apparatus of claim 2, wherein said expansion block associated with said carriage plate which, when heated, expands in a second direction along said alignment path.

4. The apparatus of claim 3, wherein said first and second directions are collinear, and wherein said expansion block is in mechanical communication with at least one of said at least two print heads to effect movement of said at least one print head in said second direction in response to expansion of said expansion block.

5. The apparatus of claim 1, wherein said heater element in thermal contact with said expansion block.

6. The apparatus of claim 1, wherein said imaging system captures an alignment pattern printed by said at least one print head.

7. The apparatus of claim 1, further comprising:

a clamping mechanism associated with a carriage plate for selectably securing said print head against movement to maintain print head alignment without regard to any of expansion of said expansion block and bias exerted by a biasing mechanism.

8. The apparatus of claim 1, further comprising:

a thermal insulator substantially between said expansion block and a carriage plate.

9. The apparatus of claim 1, wherein said expansion block is made of a material having a high thermal coefficient of expansion.

10. The apparatus of claim 9, wherein said expansion block substantially comprises any of a Zinc alloy, having a thermal coefficient of linear expansion of about 0.000019"/"/° F.; acetal, having a thermal coefficient of linear expansion of about 0.0000592"/"/° F.; acrylonitrile butadiene styrene (ABS), having a thermal coefficient of linear expansion of about 0.000041; and polyetheretherketone (PEEK), having a thermal coefficient of linear expansion of about 0.000025.

11. The apparatus of claim 1, said heater element comprising any of a silicon rubber heater and a kapton heater.

12. The apparatus of claim 7, wherein said clamping mechanism comprises a cam driven lock down.

13. The apparatus of claim 1, wherein said control system is configured to increase said heater element temperature using a pulse width modulated (PWM) drive signal.

14. The apparatus of claim 13, wherein said control system is configured to delay further application of said drive signals to allow said heater element temperature to settle.

15. The apparatus of claim 1, further comprising:

a thermocouple feedback mechanism in communication with said control system to monitor said expansion block temperature.

16. The apparatus of claim 1, wherein said control system is configured to allow said expansion block to cool, wherein a biasing mechanism urges said print head along a first direction to correct said print head alignment.

17. The apparatus of claim 1, wherein said control system is configured to signal an operator to activate a clamping mechanism to hold said print head in position once correct print head alignment has been achieved.

18. The apparatus of claim 1, wherein the control system is configured to operate an electro-mechanical actuator to engage a clamping mechanism automatically to hold said print head in position once correct print head alignment has been achieved.

19. The apparatus of claim 1, further comprising:

a separate heater element and expansion block associated with each of a plurality of said print heads.

20. The apparatus of claim 19, wherein all of said print heads are aligned to each other, wherein alignment is either performed first for one print head, and then it is performed for a next print head until all of the print heads are aligned, or all of said print heads are aligned at the same time.

21. The apparatus of claim 19, wherein one of said print heads comprises a reference print head to which all of the other print heads are aligned.

22. The apparatus of claim 1, wherein expansion of said expansion block is applied to adjust said print heads in more than one direction per print head.

23. The apparatus of claim 1, wherein expansion of said expansion block is applied to make adjustments in either, or both of, the X and Y dimensions.

24. The apparatus of claim 1, further comprising:

a reporting or recording mechanism configured to track a history of the alignment adjustments to identify changes in alignment over time.

25. The apparatus of claim 1, further comprising:

a remote diagnostics mechanism comprising sensors associated with any of said expansion block and said print heads to ascertain a location of said print heads remotely.

26. An apparatus for automated print head alignment, comprising:

an expansion block which, when heated by a heater element in thermal contact with said expansion block, expands along said alignment path;

wherein said expansion block is in mechanical communication with at least one of at least two print heads to effect movement of said at least one print head in response to expansion of said expansion block.

27. The apparatus of claim 26, further comprising:

a clamping mechanism associated with a carriage plate for selectably securing said print head against movement to maintain print head alignment without regard to any of expansion of said expansion block and bias exerted by a biasing mechanism.

28. The apparatus of claim 26, wherein said expansion block is made of a material having a high thermal coefficient of expansion.

29. The apparatus of claim 28, wherein said expansion block substantially comprises any of a Zinc alloy, having a thermal coefficient of linear expansion of about 0.000019"/"/° F.; acetal, having a thermal coefficient of linear expansion of about 0.0000592"/"/° F.; acrylonitrile butadiene styrene (ABS), having a thermal coefficient of linear expansion of about 0.000041; and polyetheretherketone (PEEK), having a thermal coefficient of linear expansion of about 0.000025.

* * * * *